US011240591B2

(12) United States Patent
Grinker et al.

(10) Patent No.: US 11,240,591 B2
(45) Date of Patent: Feb. 1, 2022

(54) INTERNAL CONTROL LEAK INTEGRATED IN A DRIVER FRAME

(71) Applicant: Apple Inc., Cupertino, CA (US)

(72) Inventors: Scott C. Grinker, Belmont, CA (US); Claudio Notarangelo, San Francisco, CA (US); Cole A. McCaughan, Santa Clara, CA (US); Ethan L. Huwe, Campbell, CA (US); Brian R. Twehues, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/583,795

(22) Filed: Sep. 26, 2019

(65) Prior Publication Data

US 2021/0099791 A1 Apr. 1, 2021

(51) Int. Cl.
*H04R 1/28* (2006.01)
*H04R 1/10* (2006.01)

(52) U.S. Cl.
CPC ..... *H04R 1/2811* (2013.01); *H04R 1/1016* (2013.01); *H04R 1/1075* (2013.01); *H04R 2460/11* (2013.01)

(58) Field of Classification Search
CPC combination set(s) only.
See application file for complete search history.

(56) References Cited

U.S. PATENT DOCUMENTS 8,331,599 B2 12/2012 Yun et al.
8,989,427 B2 3/2015 Silvestri et al.
10,028,048 B2 7/2018 Ozawa
2009/0226023 A1* 9/2009 Akino ..... H04R 1/1008 381/374
2011/0268309 A1* 11/2011 Moquin ..... H04R 1/2842 381/386
2013/0016867 A1 1/2013 Xi et al.
2013/0343594 A1 12/2013 Howes et al.
2013/0343595 A1 12/2013 Zorkendorfer et al.
2014/0068944 A1 3/2014 Aase et al.
2015/0016660 A1* 1/2015 Matsumura ..... H04R 9/06 381/415
2015/0382100 A1* 12/2015 Azmi ..... H04R 1/1016 381/380
2016/0192065 A1* 6/2016 Oosato ..... H04R 1/2826 381/378
2018/0020284 A1* 1/2018 Hirai ..... H04R 1/28
2020/0045402 A1* 2/2020 Jiang ..... H04R 1/1008

* cited by examiner

*Primary Examiner* — Fan S Tsang
*Assistant Examiner* — Angelica M McKinney
(74) *Attorney, Agent, or Firm* — Womble Bond Dickinson (US) LLP

(57) ABSTRACT

A driver assembly including a driver module having a driver frame and a diaphragm coupled to the driver frame, the driver frame defining a front volume chamber coupled to a first side of the diaphragm and a back volume chamber; an internal control leak formed through the driver frame to couple the front volume chamber to the back volume chamber; and a first driver vent and a second driver vent formed through the driver frame to couple a second side of the diaphragm to the back volume chamber, wherein a centroid of the first driver vent is aligned with a centroid of the second driver vent.

21 Claims, 5 Drawing Sheets

INTERNAL CONTROL LEAK INTEGRATED IN A DRIVER FRAME

FIELD

An embodiment of the invention is directed to internal control leaks, vents, ports or the like integrated in a driver frame. Other embodiments are also described and claimed.

BACKGROUND

Whether listening to an MP3 player while traveling, or to a high-fidelity stereo system at home, consumers are increasingly choosing intra-canal and intra-concha earphones for their listening pleasure. Both types of electro-acoustic transducer devices have a relatively low profile housing that contains a receiver or driver (an earpiece speaker). The low profile housing provides convenience for the wearer, while also providing very good sound quality.

SUMMARY

Drivers are commonly used in mobile applications such as earphones for sound output. The driver is positioned within an interior chamber formed by the earphone housing. The driver itself may include a driver frame that supports the driver components, for example, the diaphragm and forms a front volume chamber and a back volume chamber around the diaphragm. The driver front volume chamber may be coupled to an acoustic output opening of the earphone housing to output sound generated by the diaphragm to the user's ear. In some cases, where the earphone fits relatively tightly within the ear and forms a seal with the ear canal, or at least a partial seal, user's may experience an undesirable occlusion effect. To address this, aspects disclosed herein may include a number of passive leaks or vents formed within the driver frame to couple the chambers therein to one another to improve sound output (e.g., reduce occlusion effect). Representatively, the frame may include an internal control leak integrated in the frame (e.g., formed through the frame portion that supports the diaphragm) that connects the back volume to the front volume. The internal control leak may include two control leaks arranged around the driver. The internal control leaks may, in some aspects, allow for pressure equalization. In still further aspects, the frame may include a driver vent that couples the back side of the diaphragm to the back volume chamber. The driver vent may be used for low frequency tuning and/or to enlarge the size of the back volume. In some cases, the driver vent may include two elongated driver vents that are balanced or symmetrically arranged around the frame. For example, the drive vents may be arranged along opposite sides of the diaphragm and have centroids that are aligned with a center of the diaphragm. In addition, the assembly may include an external control leak that couples the front volume chamber to an ambient environment and/or a rear vent that couples the back volume chamber to the ambient environment. In some cases, the rear vent may couple the back volume chamber to another larger chamber within the enclosure to further enlarge the back volume chamber. In some cases, an acoustic mesh may be coupled to the driver vent and the internal control leak. The acoustic mesh may be insert molded in the driver frame and tuned, in conjunction with the driver vents, to a specific acoustic resistance to optimize high frequency response and acoustic damping. In some cases, the shape and/or size of the vents and/or internal control leak may be optimized to minimize a rocking of the diaphragm, asymmetric acoustic loading and/or allow airflow restrictions.

Representatively, in one aspect a driver assembly includes a driver module, an internal control leak and first and second driver vents. The drive module may have a driver frame and a diaphragm coupled to the driver frame, the driver frame defining a front volume chamber coupled to a first side of the diaphragm and a back volume chamber. The internal control leak may be formed through the driver frame to couple the front volume chamber to the back volume chamber. The first driver vent and the second driver vent may be formed through the driver frame to couple a second side of the diaphragm to the back volume chamber, and a centroid of the first driver vent is aligned with a centroid of the second driver vent. In some aspects, the internal control leak, the first driver vent and the second driver vent are formed through a same wall of the driver frame that the diaphragm is coupled to. In still further aspects, the internal control leak is a first internal control leak, and the assembly further includes a second internal control leak. The first internal control leak and the second internal control leak may be radially outward to the first driver vent and the second driver vent. In some aspects, the first driver vent and the second driver vent may have a same shape. In some cases, a shape of at least one of the first driver vent and the second driver vent may be asymmetrical. Still further, the centroid of the first driver vent and the centroid of the second driver vent may be aligned with a center of the diaphragm. In some aspects, the assembly may further include a single piece of acoustic mesh acoustically coupled to the internal control leak and one of the first acoustic vent or the second acoustic vent. In addition, the assembly may include an enclosure wall that forms an interior chamber and an acoustic outlet port to an ambient environment, wherein the driver module is positioned within the interior chamber and the acoustic outlet port couples the front volume chamber to the ambient environment.

In another aspect, a driver assembly includes an enclosure having an enclosure wall that forms an interior chamber and an acoustic outlet port coupling the interior chamber to an ambient environment. The assembly further includes a driver module positioned within the interior chamber, the driver module having a driver frame to which a diaphragm and a magnet assembly are coupled, the driver frame dividing the interior chamber into a front volume chamber coupled to a first side of the diaphragm and a back volume chamber. The assembly also includes an internal control leak formed through the driver frame to couple the front volume chamber to the back volume chamber, a first driver vent and a second driver vent formed through the driver frame to couple a second side of the diaphragm that faces the magnet assembly to the back volume chamber, and a rear vent formed through the enclosure to couple the back volume chamber to the ambient environment. The internal control leak may be positioned through a portion of the driver frame that is radially outward to a portion of the driver frame the diaphragm is coupled to. The first driver vent and the second driver vent may be positioned through a portion of the driver frame that is radially inward to a portion of the driver frame the diaphragm is coupled to. In some cases, a centroid of the first driver vent and a centroid of the second driver vent are arranged at diametrically opposed locations around the diaphragm. The first driver vent, the second driver vent and the internal control leak may each have an elongated shape. The assembly may further include a first mesh and a second mesh, the first mesh is coupled to the internal control leak and the first driver vent, and the second mesh is coupled to the second driver vent. The enclosure may include a top wall and a bottom wall connected by a side wall, the rear vent may be formed through the top wall and an external control leak coupling the front volume chamber to the ambient environment is formed through the top wall.

In another aspect, a driver assembly includes an enclosure, a driver module, an internal control leak, a driver vent, an external control leak and a rear vent. The enclosure may have an enclosure wall that forms an interior chamber and an acoustic outlet port coupling the interior chamber to an ambient environment. The driver module may be positioned within the interior chamber, the driver module having a driver frame to which a diaphragm and a magnet assembly are coupled, the driver frame dividing the interior chamber into a front volume chamber coupled to a first side of the diaphragm and a back volume chamber. The internal control leak may be formed through the driver frame to couple the front volume chamber to the back volume chamber. The driver vent may be formed through the driver frame to couple a second side of the diaphragm to the back volume chamber. The external control leak may be formed through the enclosure to couple the front volume chamber to the ambient environment. The rear vent may be formed through the enclosure to couple the back volume chamber to the ambient environment. The diaphragm may be coupled to a portion of the driver frame positioned between the internal control leak and the driver vent. In some aspects, the driver vent includes an elongated shape having a first end and a second end, and the first end is wider than the second end. In still further aspects, the driver vent may be a first driver vent, the assembly further includes a second driver vent, and a centroid of the first driver vent, a centroid of the second driver vent and a center of the diaphragm are arranged within a same vertical plane that passes through the center of the diaphragm.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

Figure 1:
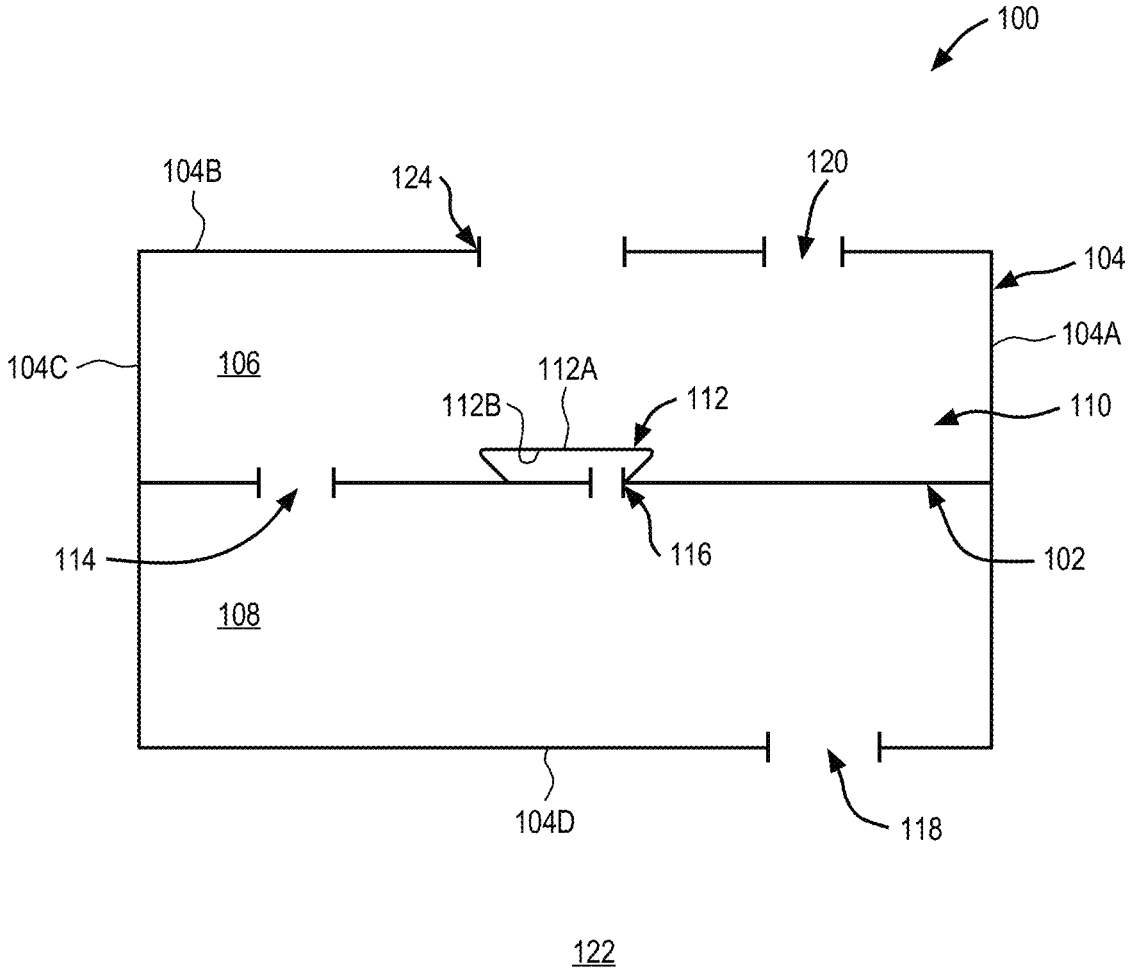
FIG. 1 illustrates a simplified schematic cross-sectional side view of one aspect of a driver assembly.

In this section we shall explain several preferred aspects of this invention with reference to the appended drawings. Whenever the shapes, relative positions and other aspects of the parts described in the aspects are not clearly defined, the scope of the invention is not limited only to the parts shown, which are meant merely for the purpose of illustration. Also, while numerous details are set forth, it is understood that some aspects of the invention may be practiced without these details. In other instances, well-known structures and techniques have not been shown in detail so as not to obscure the understanding of this description.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Intra-canal earphones or ear buds are typically designed to fit within and form a seal with the user's ear canal. Intra-canal earphones therefore have an acoustic output tube portion that extends from the housing. The open end of the acoustic output tube portion can be inserted into the wearer's ear canal. The acoustic output tube portion typically forms, or is fitted with, a flexible and resilient tip or cap made of a rubber or silicone material. When the tip portion is inserted into the user's ear, the tip compresses against the ear canal wall and creates a sealed (essentially airtight) cavity inside the canal. Although the sealed cavity allows for maximum sound output power into the ear canal, it can amplify external vibrations, thus diminishing overall sound quality. Intra-concha earphones, on the other hand, typically fit in the outer ear and rest just above the inner ear canal. Intra-concha earphones do not typically seal within the ear canal and therefore do not suffer from the same issues as intra-canal earphones. Sound quality, however, may not be optimal to the user because sound can leak from the earphone and not reach the ear canal.

FIG. 1 illustrates a cross-sectional simplified schematic side view of one aspect of a driver assembly. Driver assembly 100 may be an in-ear earphone driver, also referred to as a micro driver. For example, driver assembly 100 may be, form part of, or otherwise include components of an electroacoustic driver or transducer that converts electrical signals into acoustic signals (e.g., audible acoustic signals such as sound) that can be output from the device (or enclosure) within which the driver assembly 100 is implemented. Representatively, driver assembly 100 may be a micro speaker such as that used in an in-ear earphone or ear bud. In some aspects, for example, the driver assembly 100 may be a 10 mm to 75 mm driver, or 10 mm to 20 mm driver (as measured along the diameter or longest length dimension), for example, in the case of a micro driver.

Driver assembly 100 may include a driver frame 102, which in combination with enclosure 104, defines a front volume chamber 106 and a back volume chamber 108. Enclosure 104 may include enclosure walls 104A, 104B, 104C and 104D which form an interior chamber 110 that is surrounded by an ambient environment. For example, in some aspects, the enclosure walls may include a top wall 104B and a bottom wall 104D connected together by side walls 104A, 104C that together form the interior chamber, and separate the interior chamber from the surrounding ambient environment. It should be noted, however, that in some aspects, the area surrounding the interior chamber 110 may be another chamber, enclosure or housing. The driver frame 102 may be a single integrally formed structure, in some cases integrally formed with enclosure, or separately connected to enclosure 104. For example, the driver frame 102 may include a single integrally formed one piece structure molded into the desired frame shape so that no components are separable. For example, driver frame 102 may have at least one portion that is a relatively planar wall coupled to the enclosure 104, and that divides the encased space 110 into the front volume chamber 106 and the back volume chamber 108.

The various driver components may be coupled to the driver frame 102 and positioned within the encased space 110. For example, diaphragm 112 may be coupled (e.g., attached) to the driver frame 102. Diaphragm 112 may also be referred to herein as a sound radiating surface, an acoustic radiator, or a sound radiator, or a portion of one of these structures. Diaphragm 112 may be any type of flexible plate, membrane or other structure, capable of vibrating in response to an acoustic signal to produce acoustic or sound waves. Diaphragm 112 may include a top face 112A, which is coupled to front volume chamber 106 and generates and outputs sound to a user. The sound output by top face 112A may travel through front volume chamber 106 to an acoustic outlet port 124 formed in enclosure 104, where it is output to the surrounding ambient environment (e.g., into a user's ear). Diaphragm 112 may also include a bottom face 112B, which faces a direction opposite the top face 112A and is coupled to the back volume chamber 108. In this aspect, any acoustic or sound waves generated by the bottom face 112B do not interfere with those from the top face 112A. The top face 112A may be referred to herein as the "top" face because it faces, or includes a surface substantially parallel to, the top enclosure wall 104B. Similarly, the bottom face 112B may be referred to herein as the "bottom" face because it faces, or includes a surface substantially parallel to, the bottom enclosure wall 104D. In some aspects, diaphragm 112 may have an out-of-plane region or be substantially planar. The additional driver components used to generate the sound output (e.g., voice coil, magnet assembly, etc) will be described in more detail in reference to FIG. 2.

A number of passive leaks, vents, openings, apertures, ports or the like may further be formed within the driver assembly 100 to improve acoustic performance. It should be understood that a leak, vent, opening, aperture or port, as the terms are used herein, refer to a pathway that is formed entirely through the associated structure in which it is formed (e.g., extends from a top to bottom surface, or inner to outer surface, of a frame or enclosure wall). In some aspects, the leak, vent, opening, aperture or port is calibrated and/or tuned to achieve a desired acoustic effect. Representatively, the assembly may include an internal control leak 114 that couples the front volume chamber 106 to the back volume chamber 108. For example, the internal control leak 114 may be formed through a portion of the driver frame 102 that is outside of the diaphragm 112 and between the front volume chamber 106 and the back volume chamber 108. In addition, a driver vent 116 may couple the bottom face 112B of the diaphragm 112 to the back volume chamber 108. For example, the driver vent 116 may be formed through a portion of the driver frame 102 that is sealed to the bottom face 112B of the diaphragm (or below the diaphragm 112). The driver vent 116 may be tuned to achieve a desired diaphragm compliance, to balance occlusion effect and/or to minimize rocking modes. In still further aspects, a rear vent 118 may couple the back volume chamber 108 to the ambient environment 122 surrounding the enclosure 104. Representatively, the rear vent 118 may be formed through bottom enclosure wall 104D. The rear vent 118 may be used for tuning open ear gain. In addition, an external control leak 120 may couple front volume chamber 106 to ambient environment. Representatively, external control leak 120 may be formed through top enclosure wall 104B. Each of the internal control leak 114, driver vent 116, rear vent 118 and external control leak 120 may be tuned and/or calibrated to achieve a desired acoustic effect, for example, to minimize a rocking of the diaphragm, asymmetric acoustic loading, allow airflow restrictions reduce occlusion effect. In addition, it should be understood that although only one of each of the previously discussed vents and/or leak ports are disclosed, there may be more than one, as will be described in more detail in reference to FIGS. 3-4.

Figure 2:
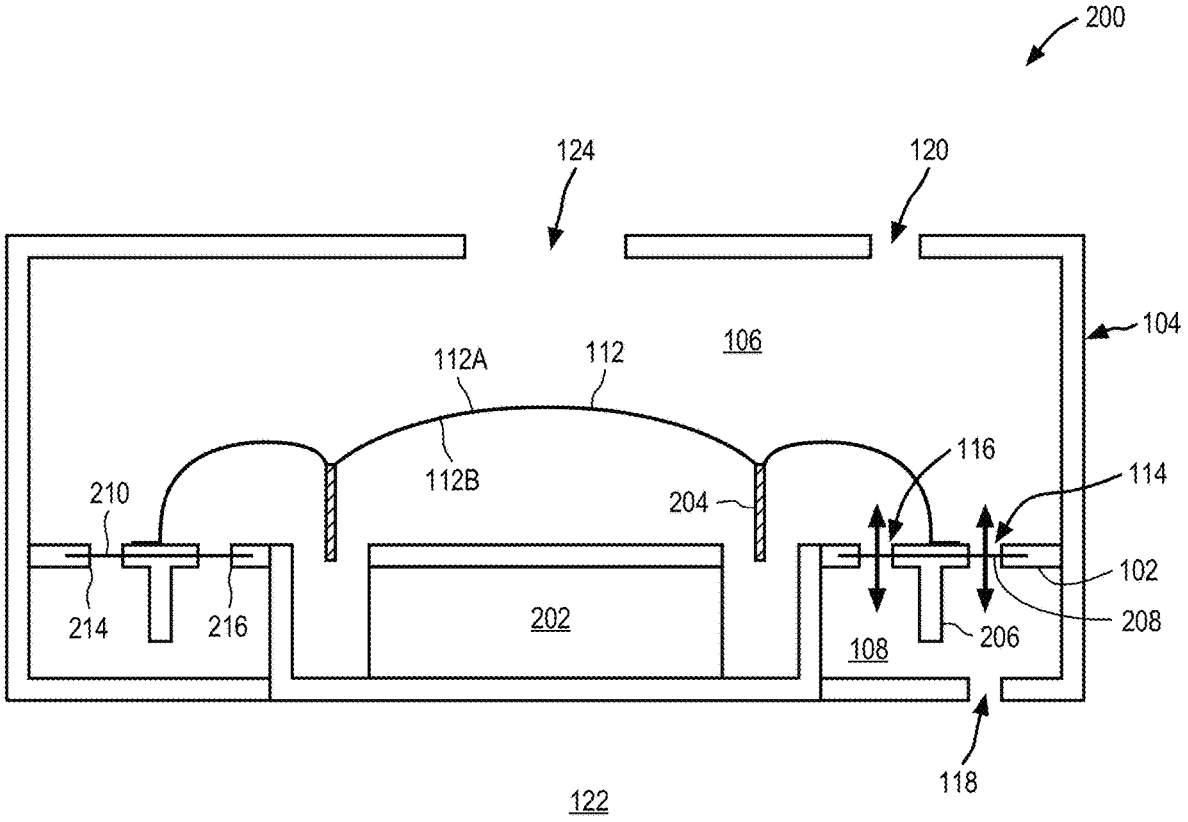
FIG. 2 illustrates a cross-sectional side view of one aspect of a driver assembly.

FIG. 2 illustrates a cross-sectional side view of another aspect of a driver assembly. Driver assembly 200 includes the same aspects as driver assembly 100 previously discussed in reference to FIG. 1, with the addition of various aspects that could not be seen in the previous view. Representatively, driver assembly 200 includes driver frame 102 and enclosure 104 which form the front volume chamber 106 and back volume chamber 108 as previously discussed. The acoustic outlet port 124, internal control leak 114, driver vent 116, rear vent 118 and external control leak 120 are further formed through the frame 102 and/or enclosure 104 as previously discussed. Diaphragm 112 is attached (e.g., chemically and/or mechanically sealed) to driver frame 102. In addition, in this view, it can be seen that a voice coil 204 may be attached to the bottom face 112B of diaphragm 112. For example, voice coil 204 may be directly attached to bottom face 112B by a chemical or mechanical attachment mechanism, or may be attached to a bobbin that is directly attached to the bottom face 112B. Magnet assembly 202 is positioned below the diaphragm 112 and voice coil 204, for example mounted to driver frame 102 and/or enclosure 104.

Magnet assembly 202 is used to drive the vibration of voice coil 204, and in turn, diaphragm 112.

Referring now in more detail to internal control leak 114 and driver vent 116, it can be seen in this view that the control leak 114 and driver vent 116 are formed through a wall of the driver frame 102 to which the diaphragm 112 is attached. Representatively, the driver frame 102 may include a relatively planar wall to which the diaphragm 112 is attached. The internal control leak 114 may be an opening, port or aperture formed through a portion of this driver wall that is radially outward to the attachment point of the diaphragm 112. In this aspect, internal control leak 114 connects the front volume chamber 106 surrounding the top side of the driver frame 102 to the back volume chamber 108 along the bottom side of the driver frame 102. The driver vent 116 may be an opening, port or aperture formed through a portion of the driver wall that is radially inward to the attachment point of the diaphragm 112. In other words, the diaphragm 112 is connected to a portion of the driver frame 102 that is between the internal control leak 114 and the drive vent 116. As previously discussed, driver vent 116 connects the bottom face 112B of diaphragm 112 (and any internal volume coupled to the bottom face) to the back volume chamber 108.

In addition, from this view it can be seen that the assembly 200 may further include a second internal control leak 214 and a second driver vent 216. The second internal control leak 214 and the second driver vent 216 may be formed through portions of the driver frame 102 near an opposite side of diaphragm 112 as shown. Similar to internal control leak 114, second internal control leak 214 may be positioned radially outward to the diaphragm 112 and connect the front volume chamber 106 to the back volume chamber 108. In addition, similar to driver vent 116, driver vent 216 may be radially inward to the point at which diaphragm 112 connects to driver frame 102 such that it connects the bottom face 112B of diaphragm 112 (and any internal volume coupled to the bottom face) to back volume chamber 108.

In some aspects, an acoustic mesh 208 may be coupled to the driver vent 116 and the internal control leak 114, and a second acoustic mesh 210 may be coupled to the second driver vent 216 and the second internal control leak 214. The acoustic mesh 208, 210 may be insert molded in the driver frame 102 so that it covers the open area of the adjacent vents 116, 216 and leaks 114, 214. The acoustic mesh 208, 210 may be tuned in conjunction with the driver vents 116, 216 and/or internal control leaks 114, 214, to a specific acoustic resistance to optimize high frequency response and acoustic damping. In some cases, the shape and/or size of the vents 116, 216 and/or internal control leaks 114, 214 may be optimized to minimize a rocking of the diaphragm, asymmetric acoustic loading and/or allow airflow restrictions. In some aspects, the size of internal control leaks 114, 214 with respect to vents 116, 216 may be tuned so the same piece of single resistance mesh can be used over both openings. Representatively, the resistance is a function of area and mesh resistance. In this aspects, the open area of the leaks/vents could be reduced by half and reduce resistance by half to get same acoustic effect. It is recognized, however, that as the open area of the leaks/vents gets smaller, tolerances play a bigger roll in variations (e.g., if ⅓ size would see more variation). Therefore the open area of the vents/leaks can be tuned within the space given to soften the tolerances.

Driver assembly 200 may further include rear vent 118 connecting the back volume chamber 108 to the ambient environment, and external control leak 120 and acoustic port 124 connecting the front volume chamber 106 to the ambient environment. When integrated into the device housing, the acoustic port 124 may be coupled to the portion of the device that is inserted into the user's ear (e.g., ear-tip) so that it is used to output sound to the ear, while the external control leak 120 is intended to remain open to reduce the occlusion effect. In some aspects, however, there is a possibility the external control leak 120 becomes occluded due to debris or human contaminants. Any comfort issues (e.g., own-voice occlusion, footfall, media playback coloration, and pull out extraction force), however, may still be avoided or minimized because there is a parallel path from the front volume chamber to the ambient environment which is also created between the internal control leak 114 and the rear vent 118. With this configuration, in the event of a sealed external control leak 120 (in ear-tip), there is still a path through the driver frame 102 and out the rear vent 118.

Figure 3:
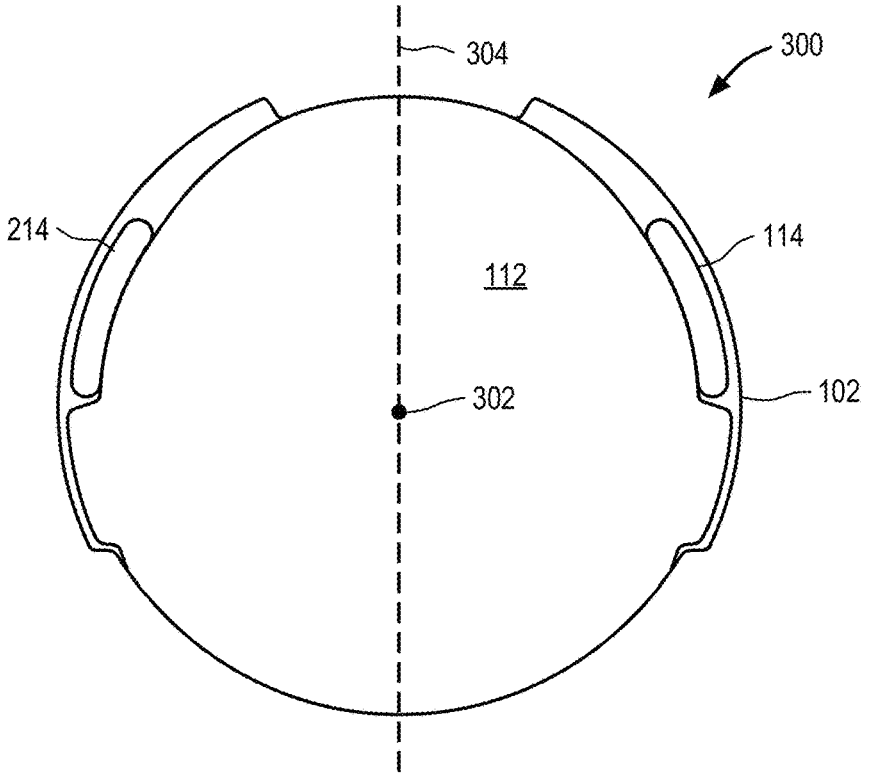
FIG. 3 illustrates a top plan view of one aspect of a driver assembly.
Figure 4:
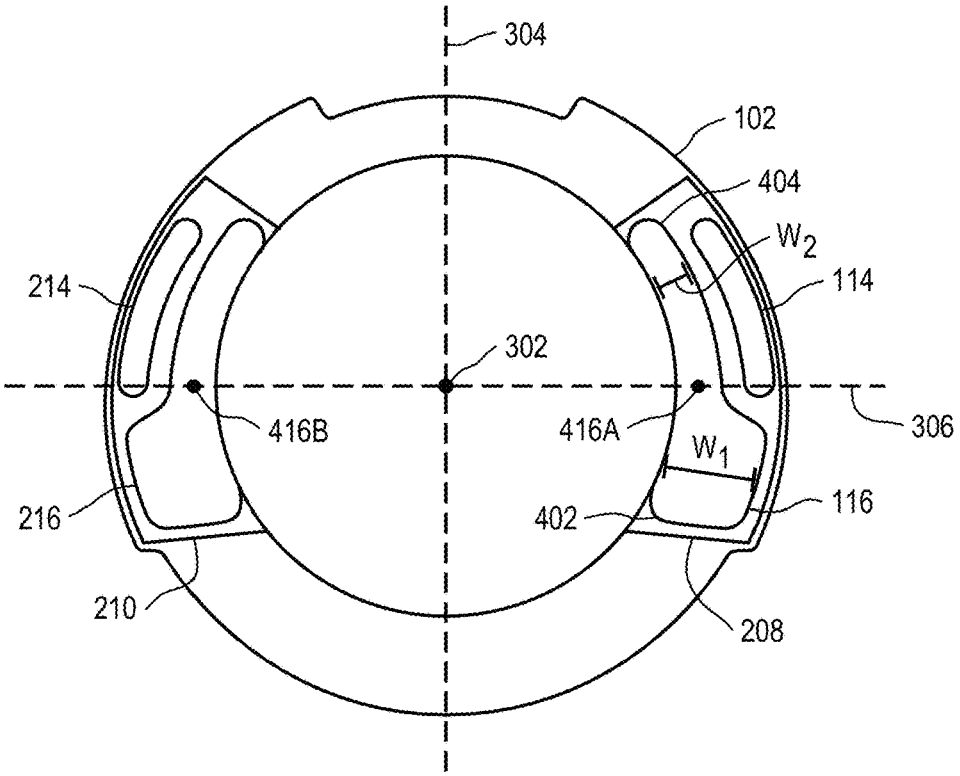
FIG. 4 illustrates a bottom plan view of one aspect of a driver assembly.

FIG. 3 and FIG. 4 illustrate a top plan view and a bottom plan view, respectively, of other aspects of the driver assembly 100, 200 with some aspects removed for ease of illustration. Representatively, from the top plan view in FIG. 3, it can be seen that diaphragm 112 is mounted to the top side of driver frame 102. Driver frame 102 is a one piece, integrally formed structure that may have a shape similar to that of the diaphragm 112. For example, diaphragm 112 may have a substantially circular shape as shown and include a center 302 (e.g., a point substantially equidistant from all points on the circle). Driver frame 102 may also have a substantially circular shape such that it provides an attachment surface for the edges of diaphragm 112 and surrounds the diaphragm 112. Internal control leaks 114, 214 are formed through portions of the driver frame that surround the diaphragm 112. In other words, internal control leaks 114, 214 are positioned around, or otherwise outside of, a foot print of diaphragm 112. In some aspects, the assembly 300, including any leaks, vents, or ports through the driver frame, may be symmetrical about at least one axis 304 through the center 302 of diaphragm 112.

FIG. 4 illustrates a bottom view of the assembly shown in FIG. 3. From this view, the size shape and location of the internal control leaks 114, 214 and driver vents 116, 216 relative to diaphragm 112 can be more clearly understood. Representatively, in one aspect, driver vents 116, 216 may be balanced relative to diaphragm 112 and/or one another to minimize rocking modes. For example, each of driver vents 116, 216 may have any size/shape so long as their respective centroids 416A, 416B (e.g., arithmetic mean position of all points in the shape) are balanced. For example, in FIG. 4 the centroids 416A, 416B are considered balanced in that they are aligned with one another, as illustrated by the dashed line 306. Said another way, the centroids 416A, 416B of the driver vents 116, 216 are arranged at diametrically opposed locations around diaphragm 112 and are therefore considered balanced. The centroids 416A, 416B are also considered aligned with the center 302 of diaphragm 112 (e.g., they are all arranged along line 306). It is recognized that since diaphragm 112 may not be planar with driver frame 102 (e.g., diaphragm 112 may be bowed in an upward direction as shown in FIG. 2), vents 116, 216 do not need to be in a same horizontal plane as the diaphragm center 302 to be considered aligned with center 302. For example, centroids 416A, 416B may be below center 302 of diaphragm, but still considered aligned with the center 302 of diaphragm 112 if they are aligned along line 306, for example within a same vertically oriented plane passing through center 302 (e.g., a vertical plane defined by line 306), or at diametrically opposed locations around diaphragm 112, as previously discussed. In one aspect, an area of the vent 116, 216 between one end of the vent and the centroid 416A, 416B is the same as the area of the vent 116, 216 between the other end and the centroid 416A, 416B, and these areas are further balanced relative to the center 302 of the diaphragm 112 (e.g., evenly distributed relative to the diaphragm center).

In some aspects, one or more of driver vents 116, 216 may have an elongated shape (e.g., a length greater than its width). The elongated shape, in some aspects, may be an asymmetrical shape. For example, one or more of driver vents 116, 216 may have an elongated shape including a first end 402 that is wider (W1) than a width (W2) at the second end 404. Representatively, vents 116, 216 may be considered to have a shape resembling that of a pan. In some aspects, driver vent 116 and driver vent 216 may have a same shape, although this is not required. For example, driver vent 116 and driver vent 216 may have a different shape so long as the centroid of each of the shapes can be aligned with one another and/or the center of the diaphragm as previously discussed.

The internal control leaks 114, 214 may further have elongated shapes as shown, although they could have any shape suitable for achieving the desired acoustic performance and that will allow them to be coupled to the same mesh as the vents 116, 216. For example, the internal control leaks 114, 214 should be positioned near the vents 116, 216 but it is not necessary for them to be balanced in the same way as the vents 116, 216. In fact, it is contemplated that in some aspects, only one internal control leak may be used, or any other number of internal control leaks necessary to achieve the desired acoustic performance. They must be near the vents 116, 216, however, so that they can share the same single piece of mesh 208, 210.

Figure 5:
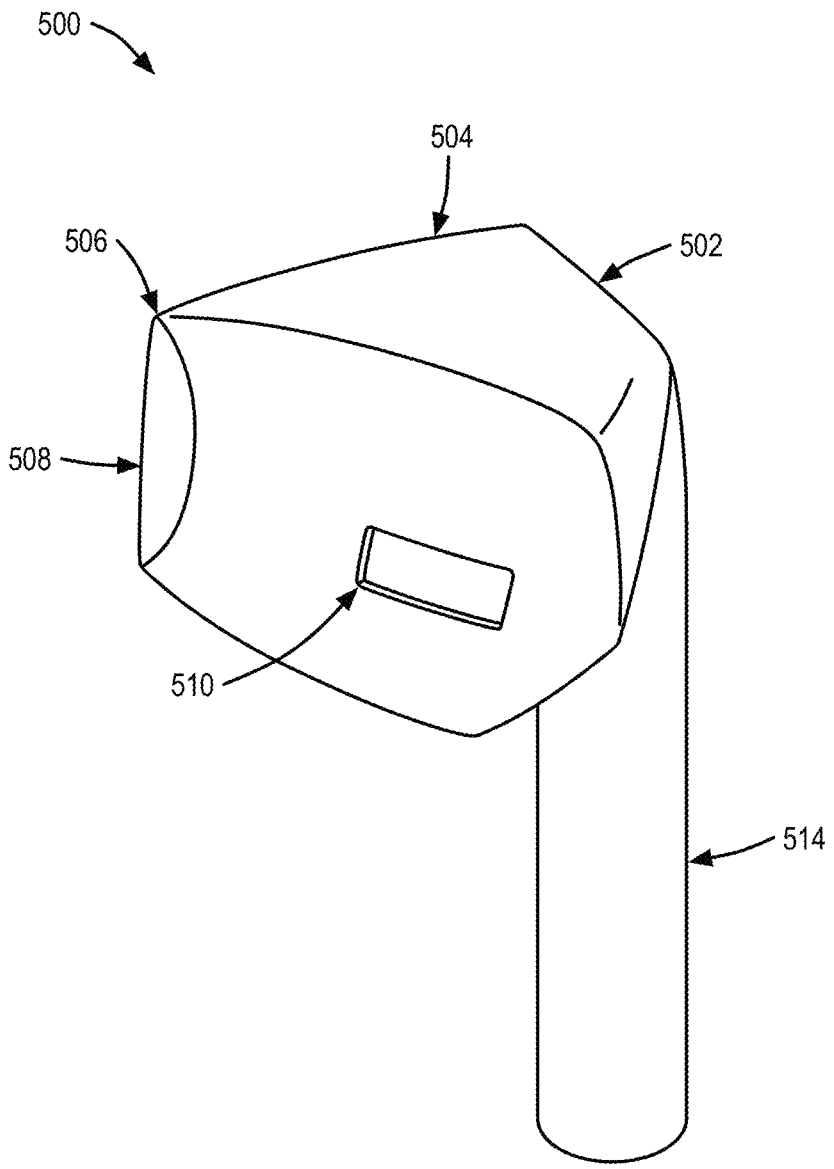
FIG. 5 illustrates a simplified schematic view of an electronic device in which a driver assembly may be implemented.

FIG. 5 illustrates a perspective view of one representative device within which the driver assembly may be implemented. Representatively, in one aspect, device 500 may be an in-ear earphone or ear bud dimensioned to rest within a concha of an ear (in this example, a right ear) and extend into the ear canal. Representatively, earphone housing 502 (which may be formed by enclosure 104) may include a body portion 504 which rests within the concha of the ear, a tip portion 506 which extends into the ear canal, and a tube portion 514 which extends outside of the ear. In some aspects, the tip portion 506 may include, or otherwise be coupled to, a flexible in-ear tip region to achieve a more fully sealed in-ear ear bud. A driver assembly (e.g., driver assembly 100, 200) may be contained within housing 502. The tip portion 506 may include an acoustic opening 508 (e.g., acoustic outlet port 124) to output sound generated by the driver assembly to the ear. One or more ports 510 to the ambient environment (e.g., rear vent118, external control leak 120, etc.) may further be formed in the housing 502.

Figure 6:
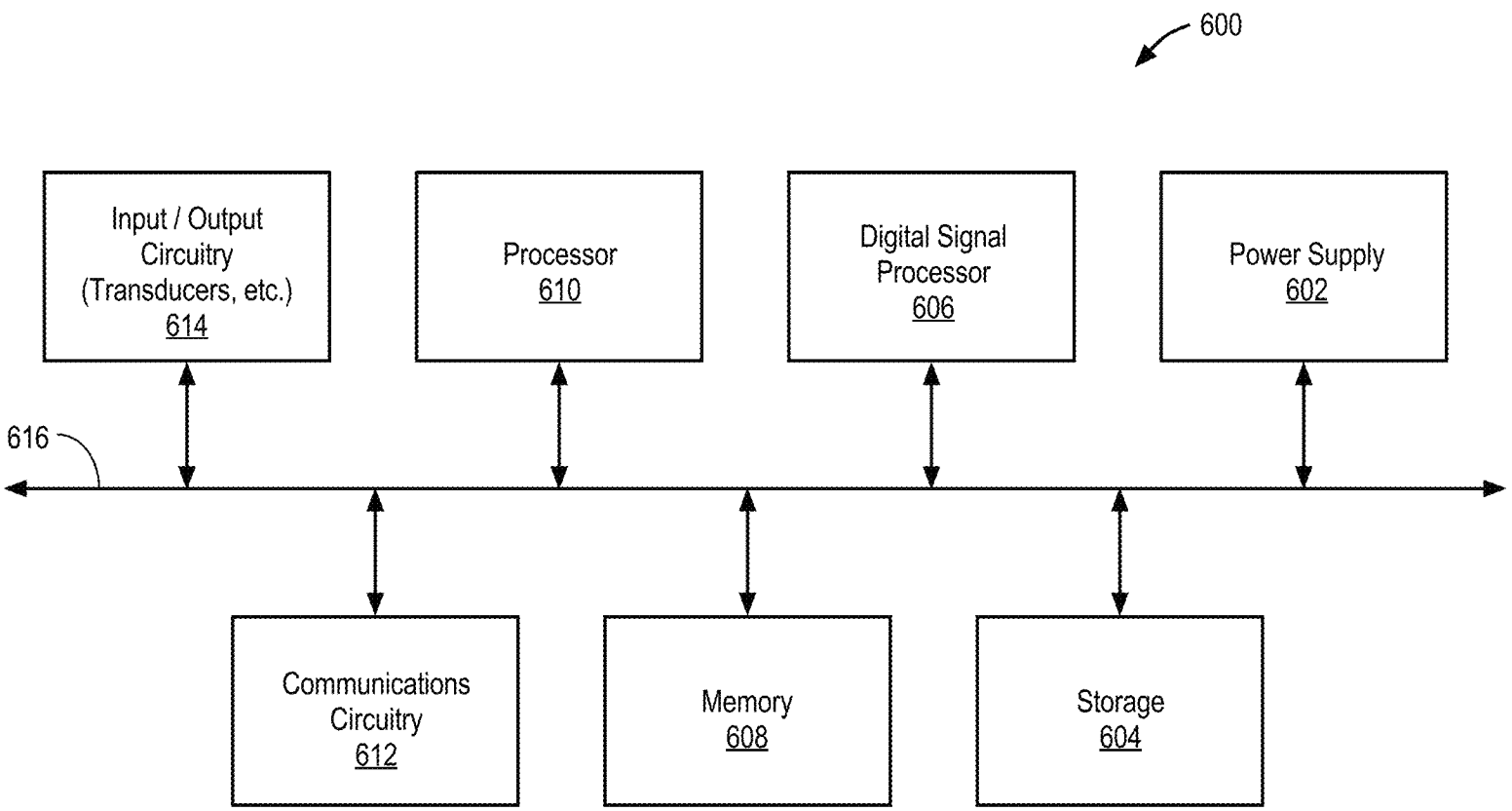
FIG. 6 illustrates a block diagram of some of the constituent components of an electronic device in which a driver assembly may be implemented.

FIG. 6 illustrates a block diagram of some of the constituent components of an electronic device in which the driver assembly disclosed herein may be implemented. Device 600 may be any one of several different types of consumer electronic devices, for example, any of those discussed in reference to FIG. 1-5.

Electronic device 600 can include, for example, power supply 602, storage 604, signal processor 606, memory 608, processor 610, communication circuitry 612, and input/output circuitry 614. In some embodiments, electronic device 600 can include more than one of each component of circuitry, but for the sake of simplicity, only one of each is shown in FIG. 6. In addition, one skilled in the art would appreciate that the functionality of certain components can be combined or omitted and that additional or less components, which are not shown in FIGS. 1-5, can be included in, for example, earphone 500.

Power supply 602 can provide power to the components of electronic device 600. In some embodiments, power supply 602 can be coupled to a power grid such as, for example, a wall outlet. In some embodiments, power supply 602 can include one or more batteries for providing power to a earphone or other type of electronic device associated with the earphone. As another example, power supply 602 can be configured to generate power from a natural source (e.g., solar power using solar cells).

Storage 604 can include, for example, a hard-drive, flash memory, cache, ROM, and/or RAM. Additionally, storage 604 can be local to and/or remote from electronic device 600. For example, storage 604 can include integrated storage medium, removable storage medium, storage space on a remote server, wireless storage medium, or any combination thereof. Furthermore, storage 604 can store data such as, for example, system data, user profile data, and any other relevant data.

Signal processor 606 can be, for example a digital signal processor, used for real-time processing of digital signals that are converted from analog signals by, for example, input/output circuitry 614. After processing of the digital signals has been completed, the digital signals could then be converted back into analog signals. For example, the signal processor 606 could be used to analyze digitized audio signals received from an error microphone to determine how much of the audio signal is ambient noise or earphone noise and how much of the audio signal is, for example, music signals.

Memory 608 can include any form of temporary memory such as RAM, buffers, and/or cache. Memory 608 can also be used for storing data used to operate electronic device applications (e.g., operation system instructions).

In addition to signal processor 606, electronic device 600 can additionally contain general processor 610. Processor 610 can be capable of interpreting system instructions and processing data. For example, processor 610 can be capable of executing instructions or programs such as system applications, firmware applications, and/or any other application. Additionally, processor 610 has the capability to execute instructions in order to communicate with any or all of the components of electronic device 600. For example, processor 610 can execute instructions stored in memory 608.

Communication circuitry 612 may be any suitable communications circuitry operative to initiate a communications request, connect to a communications network, and/or to transmit communications data to one or more servers or devices within the communications network. For example, communications circuitry 612 may support one or more of Wi-Fi (e.g., a 802.11 protocol), Bluetooth®, high frequency systems, infrared, GSM, GSM plus EDGE, CDMA, or any other communication protocol and/or any combination thereof.

Input/output circuitry 614 can convert (and encode/decode, if necessary) analog signals and other signals (e.g., physical contact inputs, physical movements, analog audio signals, etc.) into digital data. Input/output circuitry 614 can also convert digital data into any other type of signal. The digital data can be provided to and received from processor 610, storage 604, memory 608, signal processor 606, or any other component of electronic device 600. Input/output circuitry 614 can be used to interface with any suitable input or output devices. Furthermore, electronic device 600 can include specialized input circuitry associated with input devices such as, for example, one or more proximity sensors, accelerometers, etc. Electronic device 600 can also include specialized output circuitry associated with output devices such as, for example, one or more speakers, earphones, headphones, etc.

Lastly, bus 616 can provide a data transfer path for transferring data to, from, or between processor 610, storage 604, memory 608, communications circuitry 612, and any other component included in electronic device 600. Although bus 616 is illustrated as a single component in FIG. 6, one skilled in the art would appreciate that electronic device 600 may include one or more components.

While certain aspects have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting. In addition, to aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. A driver assembly comprising:

a driver module having a driver frame and a diaphragm coupled to the driver frame, the driver frame defining a front volume chamber coupled to a first side of the diaphragm and a back volume chamber;

an internal control leak formed through the driver frame to couple the front volume chamber to the back volume chamber; and a first driver vent and a second driver vent formed through the driver frame to couple a second side of the diaphragm to the back volume chamber, wherein the first driver vent or the second driver vent comprises an asymmetrical shape and a centroid of the first driver vent is aligned with a centroid of the second driver vent.

2. The driver assembly of claim 1 wherein the internal control leak, the first driver vent and the second driver vent are formed through a same wall of the driver frame that the diaphragm is coupled to.

3. The driver assembly of claim 1 wherein the internal control leak is a first internal control leak, the assembly further comprising a second internal control leak.

4. The driver assembly of claim 3 wherein the first internal control leak and the second internal control leak are radially outward to the first driver vent and the second driver vent.

5. The driver assembly of claim 1 wherein the first driver vent and the second driver vent have a same shape.

6. The driver assembly of claim 1 wherein a shape of the first driver vent and the second driver vent is asymmetrical.

7. The driver assembly of claim 1 wherein the centroid of the first driver vent and the centroid of the second driver vent are aligned with a center of the diaphragm.

8. The driver assembly of claim 1 further comprising:

a single piece of acoustic mesh acoustically coupled to the internal control leak and one of the first driver vent or the second driver vent.

9. The driver assembly of claim 1 further comprising:

an enclosure having an enclosure wall that forms an interior chamber and an acoustic outlet port to an ambient environment, wherein the driver module is positioned within the interior chamber and the acoustic outlet port couples the front volume chamber to the ambient environment.

10. An ear bud having a driver assembly comprising:

an enclosure having an enclosure wall that forms an interior chamber and an acoustic outlet port coupling the interior chamber to an ambient environment;

a driver module positioned within the interior chamber, the driver module having a driver frame to which a diaphragm and a magnet assembly are coupled, the driver frame dividing the interior chamber into a front volume chamber coupled to a first side of the diaphragm and a back volume chamber;

an internal control leak formed through the driver frame to couple the front volume chamber to the back volume chamber;

a first driver vent and a second driver vent formed through the driver frame to couple a second side of the diaphragm that faces the magnet assembly to the back volume chamber; and a rear vent formed through the enclosure to couple the back volume chamber to the ambient environment.

11. The driver assembly of claim 10 wherein the internal control leak is positioned through a portion of the driver frame that is radially outward to a portion of the driver frame the diaphragm is coupled to.

12. The driver assembly of claim 10 wherein the first driver vent and the second driver vent are positioned through a portion of the driver frame that is radially inward to a portion of the driver frame the diaphragm is coupled to.

13. The driver assembly of claim 10 wherein a centroid of the first driver vent and a centroid of the second driver vent are arranged at diametrically opposed locations around the diaphragm.

14. The driver assembly of claim 10 wherein the first driver vent, the second driver vent and the internal control leak each comprise an elongated shape.

15. The driver assembly of claim 10 further comprising:

a first mesh and a second mesh, the first mesh is coupled to the internal control leak and the first driver vent, and the second mesh is coupled to the second driver vent.

16. The driver assembly of claim 10 wherein the enclosure comprises a top wall and a bottom wall connected by a side wall, the rear vent is formed through the bottom wall and an external control leak coupling the front volume chamber to the ambient environment is formed through the top wall.

17. A driver assembly comprising:

an enclosure having an enclosure wall that forms an interior chamber and an acoustic outlet port coupling the interior chamber to an ambient environment;

a driver module positioned within the interior chamber, the driver module having a driver frame to which a diaphragm and a magnet assembly are coupled, the driver frame dividing the interior chamber into a front volume chamber that couples a first side of the diaphragm to the acoustic outlet port and a back volume chamber;

an internal control leak formed through the driver frame to couple the front volume chamber to the back volume chamber;

a driver vent formed through the driver frame to couple a second side of the diaphragm to the back volume chamber;

an external control leak formed through the enclosure to couple the front volume chamber to the ambient environment; and a rear vent formed through the enclosure to couple the back volume chamber to the ambient environment.

18. The driver assembly of claim 17 wherein the diaphragm is coupled to a portion of the driver frame positioned between the internal control leak and the driver vent.

19. The drive assembly of claim 17 wherein the driver vent comprises an elongated shape having a first end and a second end, and the first end is wider than the second end.

20. The driver assembly of claim 17 wherein the driver vent is a first driver vent, the assembly further comprising a second driver vent, and wherein a centroid of the first driver vent, a centroid of the second driver vent and a center of the diaphragm are arranged within a same vertical plane that passes through the center of the diaphragm.

21. The driver assembly of claim 17 wherein the internal control leak and the rear vent are coupled such that the rear vent also couples the front volume chamber to the ambient environment.

* * * * *